US009567755B2

(12) United States Patent
Ramachandra

(10) Patent No.: US 9,567,755 B2
(45) Date of Patent: Feb. 14, 2017

(54) SOUND-ABSORBING INTERLOCKING FLOOR PANELS AND SYSTEM

(71) Applicant: ARMSTRONG WORLD INDUSTRIES, INC., Lancaster, PA (US)

(72) Inventor: Sunil Ramachandra, Lancaster, PA (US)

(73) Assignee: AFI Licensing LLC, Lancaster, PA (US)

( * ) Notice: Subject to any disclaimer, the term of this patent is extended or adjusted under 35 U.S.C. 154(b) by 0 days.

(21) Appl. No.: 14/580,347

(22) Filed: Dec. 23, 2014

(65) Prior Publication Data

US 2016/0177578 A1 Jun. 23, 2016

(51) Int. Cl.

*E04F 15/04* (2006.01)
*E04F 15/02* (2006.01)
*E04F 15/10* (2006.01)

(52) U.S. Cl.

CPC ..... *E04F 15/041* (2013.01); *E04F 15/02038* (2013.01); *E04F 15/102* (2013.01); *E04F 15/107* (2013.01); *E04F 2201/0146* (2013.01); *E04F 2201/0153* (2013.01); *E04F 2290/041* (2013.01)

(58) Field of Classification Search

CPC ..... E04F 2201/0535; E04F 2201/0146; E04F 2201/0564; E04F 2201/069; E04F 2201/091; E04F 15/02016; E04F 15/04; E04F 15/02022; E04F 15/02038; E04C 2/38; E04C 2/30

USPC ..... 52/591.3, 592.1, 591.1, 589.1, 588.1,52/578, 581, 390–392

See application file for complete search history.

(56) References Cited

U.S. PATENT DOCUMENTS

| | | | | |
|---|---|---|---|---|
| 5,103,614 | A | 4/1992 | Kawaguchi et al. | |
| 6,505,452 | B1 | 1/2003 | Hannig et al. | |
| 6,681,820 | B2 | 1/2004 | Olofsson | |
| 6,854,235 | B2 | 2/2005 | Martensson | |
| 7,441,384 | B2 | 10/2008 | Miller et al. | |
| 7,866,115 | B2 * | 1/2011 | Pervan | B27F 1/06 52/581 |
| 8,234,829 | B2 * | 8/2012 | Thiers | B32B 7/02 52/392 |
| 8,484,920 | B2 | 7/2013 | Thiers et al. | |
| 8,720,151 | B2 | 5/2014 | Pervan | |
| 2010/0281810 | A1 * | 11/2010 | Ruland | E04F 15/02 52/588.1 |

(Continued)

*Primary Examiner* — Rodney Mintz

(57) ABSTRACT

A sound-absorbing floating floor system includes a plurality of interlocking floor panels. Each floor panel includes a main body, a first locking edge portion defining a first locking tab and channel, and a second locking edge portion defining a second locking tab and channel. The first locking tab comprises a terminal cap portion. The first locking edge portion may comprise upper and lower rigid core layers and a resilient layer interspersed therebetween. The resilient layer extends through the first locking edge portion to isolate the cap portion of the first locking tab from the lower rigid core layer. In some embodiments, the main body includes the resilient layer which extends into the first locking edge portion. The second locking edge portion may also include the resilient layer. A plurality of floor panels may be assembled and interlocked via the locking tabs and channels to form a floating floor system.

20 Claims, 8 Drawing Sheets

(56) References Cited

U.S. PATENT DOCUMENTS

| | | | | |
|---|---|---|---|---|
| 2013/0047536 | A1* | 2/2013 | Pervan | B26D 1/14 52/309.1 |
| 2013/0199120 | A1 | 8/2013 | Bergelin et al. | |
| 2014/0290158 | A1* | 10/2014 | Meersseman | B32B 7/12 52/177 |
| 2016/0177576 | A1* | 6/2016 | Ramachandra | E04F 15/02016 52/588.1 |

* cited by examiner

SOUND-ABSORBING INTERLOCKING FLOOR PANELS AND SYSTEM

FIELD

The present disclosure relates to locking flooring systems, and more particularly to floor panels having interlocking edge features.

BACKGROUND

Interlocking flooring systems of various types are known. One type of flooring is often referred to as "floating" because none of the floor panels, whether they are elongated rectangular panels or less elongated panels, are secured to the subfloor. To provide both vertical and horizontal locking at joints along the long and short edges between adjacent panels, specially configured edge profiles having variously angled mating surfaces have been used. The long edges may be interlocked by "fold-to-lock" arrangements while interlocking along the short edges may be interlocked by "push-to-lock" arrangements. At the fold-to-lock joints, the long edge of a first floor panel is first inserted laterally at angle to a second floor panel already positioned on a subfloor. The first floor panel is then folded downwards onto the subfloor to form locking engagement between the panels at the long edges. Occurring substantially simultaneously with this folding motion during installation, the short edge of the first floor panel is inserted and pushed vertically into the short edge of a third floor panel already positioned on a subfloor adjacent to the first plate at the short edge producing the push-to-lock joint. It will be appreciated by those skilled in the art that only either the long or short edges may be angularly inserted into already laid floor panels using the fold-to-lock engagement.

The foregoing fold-to-lock and push-to-lock interlocking features have been used with different types of flooring materials, including floor panels made of rigidly structured hardwood, high density fiberboard (HDF), medium density fiberboard (MDF) or other rigidly structured materials. For such rigid floor panels, however, achieving locking on the short edges in particular often presents two issues.

The first issue is achieving suitable locking engagement between two adjacent panels along the short edges. For panels made from materials with a higher hardness, the short edge push-to-lock locking profiles need to meet exacting fabrication tolerances so that the mating locking profiles can effectively engage and lock with each other. Tools such as a mallet may be needed in order to force the short edges into locking engagement, which creates the potential for damaging the flooring.

The second issue with relatively rigid floor panels concerns noise which develops from movement within the locking joints particularly as the flooring ages. The rigid mating materials of the floor panels at the joints may rub together. Because the rubbing materials are rigid, noises such as moans, squeaks, or creaks may be produced when the floor is walked upon which is objectionable.

An improved interlocking floor panel and system is desired for rigid floor panels.

SUMMARY

In one embodiment, a floating floor system includes a plurality of floor panels each comprising: a main body comprising a first surface and a second surface; a first locking edge portion extending from a first side of the main body, the first locking edge portion comprising a first locking tab and a first locking channel, the first locking channel located between the first locking tab and the main body, the first locking tab comprising a cap portion and forming a first outer sidewall of the first locking channel; a second locking edge portion extending from a second side of the main body opposite the first side, the second locking edge portion comprising a second locking tab and a second locking channel, the second locking channel located between the second locking tab and the main body; the first locking edge portion comprising an upper rigid core layer, a first flexible layer, and a lower rigid core layer, the first flexible layer disposed between the upper and lower rigid core layers, the cap portion of the first locking tab formed by the upper rigid core layer; and the first flexible layer extending through the first locking edge portion to isolate the cap portion of the first locking tab from the lower rigid core layer. The plurality of floor panels are arranged in a mechanically interlocked arrangement in which the second locking tabs of the plurality of floor panels nest within the first locking channels of adjacent ones of the plurality of floor panels and the first locking tabs of the plurality of floor panels nest within the second locking channels of the adjacent ones of the plurality of floor panels.

In another embodiment, a floating floor system includes a plurality of floor panels each comprising: a main body comprising an upper rigid core layer defining a first surface and a lower rigid core layer defining a bottom surface; the main body including a resilient layer interspersed between the upper and lower rigid core layers, the resilient layer extending horizontally between the upper and lower rigid core layers, the resilient layer being formed of a compressible material having a lower hardness than the upper and lower rigid core layers; a first locking edge portion extending laterally from a first side of the main body, the first locking edge portion comprising a first locking tab and a first locking channel, the first locking channel located between the first locking tab and the main body, the first locking tab comprising a first cap portion and forming a first outer sidewall of the first locking channel; and a second locking edge portion extending from a second side of the main body opposite the first side, the second locking edge portion comprising a second locking tab and a second locking channel, the second locking channel located between the second locking tab and the main body, the second locking tab comprising a second cap portion and forming a second outer sidewall of the second locking channel; the first cap portion being formed by the upper rigid core layer, the resilient layer extending from the main body of the floor panel through the first locking edge portion to isolate the first cap portion of the first locking tab from the lower rigid core layer. The plurality of floor panels are arranged in a mechanically interlocked arrangement in which the second locking tabs of the plurality of floor panels nest within the first locking channels of adjacent ones of the plurality of floor panels and the first locking tabs of the plurality of floor panels nest within the second locking channels of the adjacent ones of the plurality of floor panels.

A floor panel for a floating floor system is provided. In one embodiment, the floor panel includes: an upper rigid core defining a top surface; a lower rigid core comprising a bottom surface; a compressible intermediate layer disposed between the top and lower cores, the upper core, lower core, and intermediate layer collectively defining a main body of the panel; a peripheral first locking edge portion extending laterally from a first side of the main body, the first locking edge portion comprising a first locking tab and a first locking channel, the first locking channel located between the first locking tab and the main body, the first locking channel defined by a channel floor, an inner sidewall extending upward from the channel floor, and an outer sidewall extending upward from the channel floor, the first locking tab comprising a first cap portion and forming a first outer sidewall of the first locking channel; a peripheral second locking edge portion extending from a second side of the main body opposite the first side, the second locking edge portion comprising a second locking tab and a second locking channel, the second locking channel located between the second locking tab and the main body, the second locking channel defined by a channel roof, an inner sidewall extending downward from the channel roof, and an outer sidewall extending downward from the channel floor, and the second locking tab comprising a second cap portion and forming a second outer sidewall of the second locking channel. The first cap portion is formed by the upper rigid core layer. The compressible layer extends from the main body of the floor panel through the first locking edge portion to isolate the first cap portion of the first locking tab from the lower rigid core layer.

In another embodiment, a floor panel for a floating floor system includes: a main body comprising a first surface and a second surface; a first locking edge portion extending from a first side of the main body, the first locking edge portion comprising a first locking tab and a first locking channel, the first locking channel located between the first locking tab and the main body, the first locking tab comprising a cap portion and forming a first outer sidewall of the first locking channel; a second locking edge portion extending from a second side of the main body opposite the first side, the second locking edge portion comprising a second locking tab and a second locking channel, the second locking channel located between the second locking tab and the main body; the first locking edge portion comprising a first layer having a first hardness, a second layer having a second hardness, and a third layer having a third hardness, the second layer disposed between the upper and lower core layers, the cap portion of the first locking tab formed by the first layer; and the second layer extending through the first locking edge portion to isolate the cap portion of the first locking tab from the third layer. The second hardness of the second layer is less than the first and third hardness of the first and third core layers respectively.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures, in which similar elements are labeled the same, and wherein.

Figure 1A:
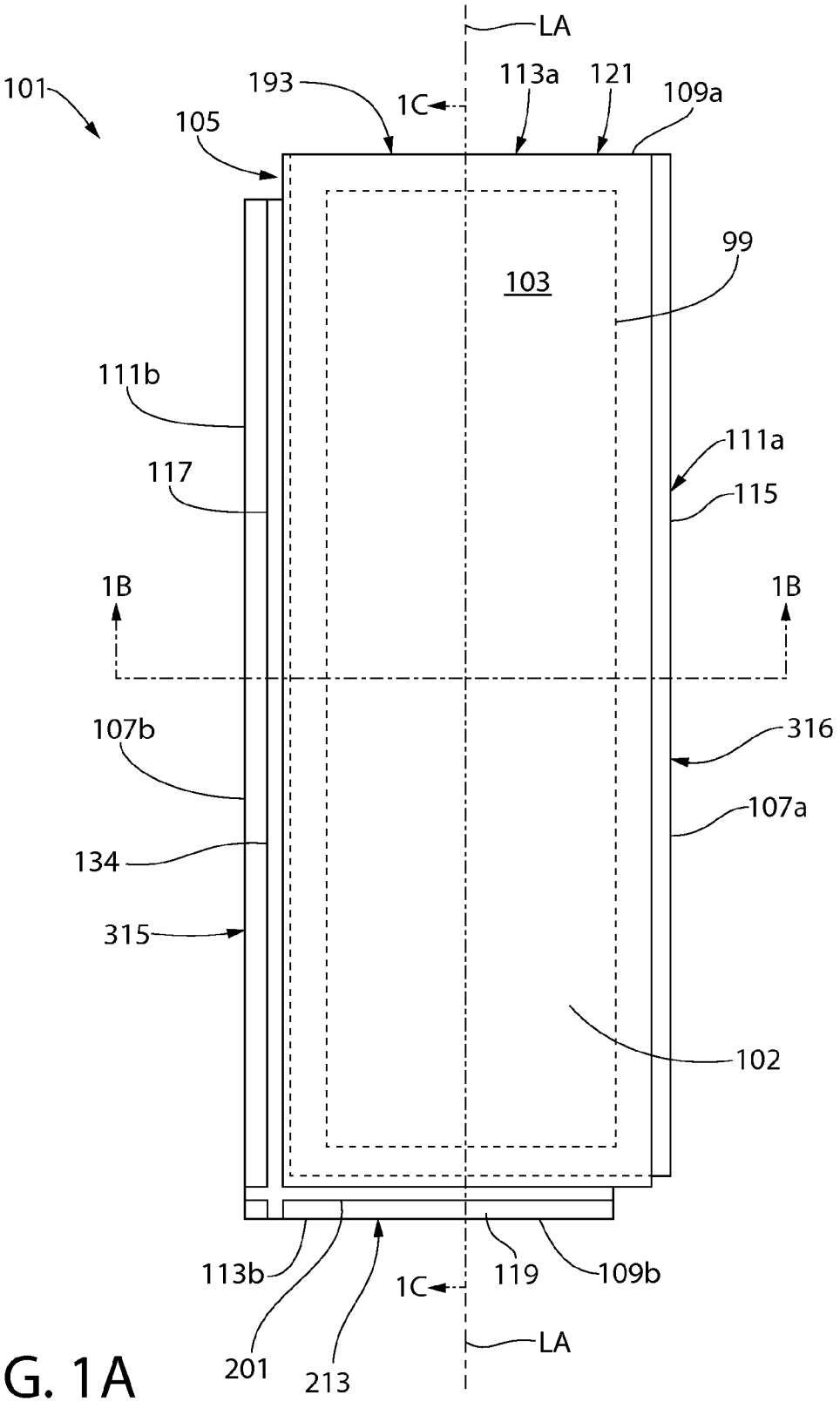
FIG. 1A is a top plan view of an interlocking floor panel of a floating floor system that includes a sound-absorbing layer and at least one locking edge portion including a compressible material that is more resilient than the core layers of the panel.

All drawings are schematic and not necessarily to scale.

DETAILED DESCRIPTION

The features and benefits of the present disclosure are illustrated and described herein by reference to exemplary embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments.

As used herein, the terms "panel", "tile", and "board" may be used interchangeably, and where there is a size or compositional difference, the difference will be expressly stated.

Turning to FIG. 1A, a rectangular floor panel 101 having a plank shape is shown. Floor panel 101 comprises a main body 102 having a generally planar or flat sheet-like construction which with a length and width substantially greater than its thickness. The main body 102 defines a top surface 103 and opposite bottom surface 105. In this non-limiting exemplary embodiment, the central main body 102 of the floor panel 101 includes a top surface 103 having a surface area similar to the bottom surface 105. The floor panel 101 has long edges 107*a*, 107*b* extending parallel to a longitudinal axis LA and short edges 109*a*, 109*b* extending perpendicular to longitudinal axis LA. The long and short edges define peripheral sides of floor panel 101.

Long edges 107*a*, 107*b* define a length of floor panel 101 and short edges 109*a*, 109*b* define a width. Each of the long edges 107*a*, 107*b* has a peripheral locking edge portion 111*a*, 111*b*, which extends laterally outwards and horizontally from respective opposite sides of the main body 102, and each of the short edges 109*a*, 109*b* has a peripheral locking edge portion 113*a*, 113*b*, which extends longitudinally outwards and horizontally from respective opposite sides of the main body 102. The locking edge portion 111*a* includes a first locking profile 115, and the locking edge portion 111*b* includes a second locking profile 117. Each locking profile 115, 117 is complementary in shape/configuration to the other locking profile 115, 117, respectively, so that the first locking profile 115 of a first floor panel may be interlocked in locking engagement with the second locking profile 117 of a second floor panel, as further described herein.

It should be noted that the central main body 102 as described herein is considered to be that interior region of floor panel 101 between the peripheral locking edge portions 111*a*, 111*b*, 113*a*, and 113*b* where the floor panel generally has a full thickness of material and does not include the reduced thickness locking profiles 115, 117, 119, and 121 described herein.

Similarly, locking edge portion 113*a* includes a first locking profile 119, and locking edge portion 113*b* includes a second locking profile 121. Each locking profile 119, 121 is complementary in shape/configuration to the other locking profile 119, 121, respectively, so that the locking profile 119 of a first floor panel may couple in locking engagement with the locking profile 121 of a second floor panel.

In certain embodiments, one of the long edges 107*a*, 107*b* or short edges 109*a*, 109*b* may be configured to be of the "fold-and-lock" type, and the other of the long edges 107*a*, 107*b* or short edges 109*a*, 109*b* may be configured as a "push-and-lock" type. Both types of locking engagement edge profiles are well known in the art, and either type may be placed along the short edge or the long edge of a floor panel.

The length ratio of the long edges 107*a*, 107*b* of the floor panel 101 to the short edges 109*a*, 109*b* of the floor panel 101 may vary in accordance with design choice. In certain embodiments, the long edges 107*a*, 107*b* may be significantly longer than the short edges 109*a*, 109*b* defining a plank shape, and in other embodiments, all four edges 107*a*, 107*b*, 109*a*, 109*b* may be of equal length. When all four edges are equal, the locking profiles are the only features which distinguish the "long edges" from the "short edges."

Figure 1B:
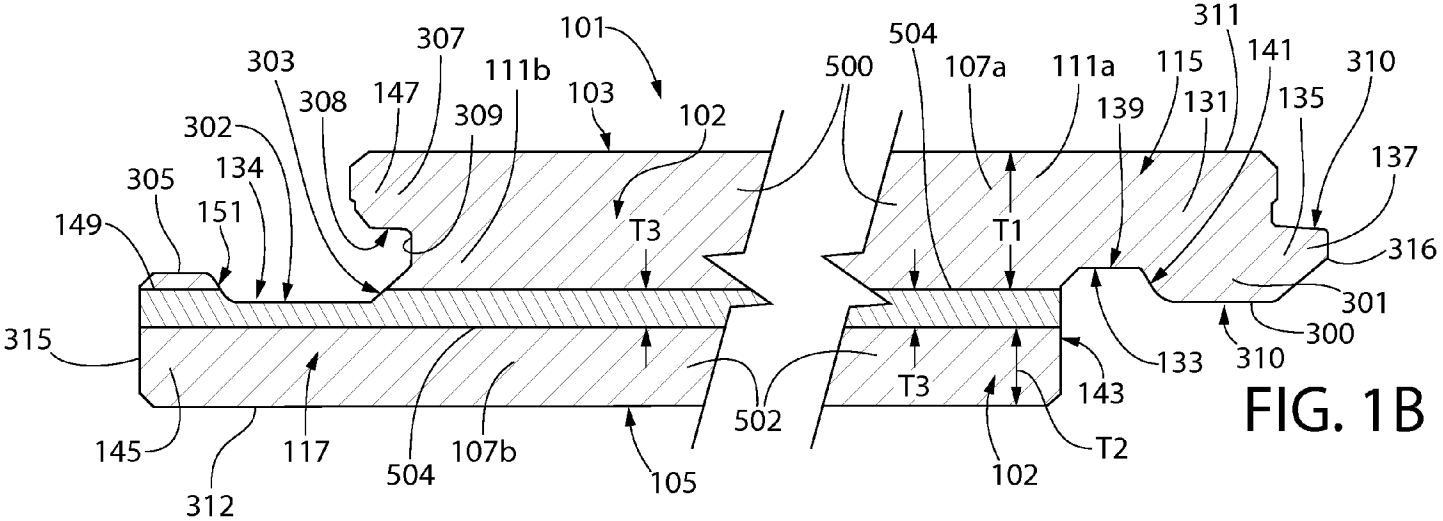
FIG. 1B is a side cross sectional view of the floor panel taken along the line 1B-1B in FIG. 1A.
Figure 1C:
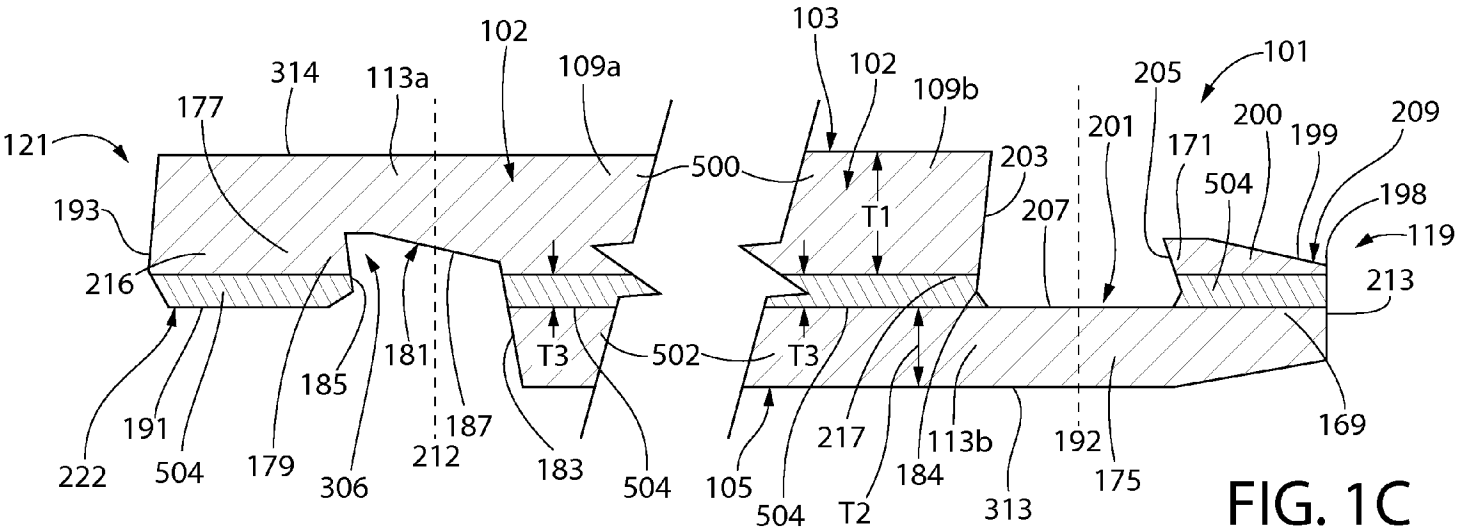
FIG. 1C shows a side cross sectional view of the floor panel taken along the line 1C-1C in FIG. 1A.

FIGS. 1B and 1C are cross sectional views of the long and short edges of floor panel 101, respectively.

As shown in FIG. 1B, the first locking edge portion 111*a* defining locking profile 115 of the first long edge 107*a* includes a horizontal locking feature 131, which is formed by locking channel 133, and a vertical locking feature 135, which is formed by a laterally outward extending tongue 137. The channel 133 is formed by a channel roof 139, an outer wall surface 141 extending downwards from the roof, and an inner wall surface 143 extending downwards from the roof and spaced horizontally apart from outer wall surface 141. The locking channel 133 defines a downward facing opening configured to receive locking tab 149 of locking edge profile 117.

Locking profile 115 includes a peripheral outer sidewall 316, a laterally protruding cantilever arm 311 and a vertically protruding locking tab 301 extending in a downwards direction from channel roof 139. Outer sidewall 141 is defined by an inner portion of tab 301. Tongue 137 may be considered to extend laterally outwards from tab 301. In one embodiment, tab 301 further includes a terminal cap portion 300 which defines an exposed bottom surface 310 facing in a downward direction. Surface 310 and mating channel floor 302 of locking edge portion 111*b* may both be oriented substantially parallel to top surface 103 of floor panel 101 in one embodiment. In other embodiments, each of bottom surface 310 and channel floor 302 may be arranged proximately and parallel to each other when the flooring joint is assembled (see, e.g. FIG. 2).

In one embodiment, tab 301 and cap portion 300 are vertically offset from the bottom surface 105 of floor panel 101. This creates a vertical gap between a subfloor and locking edge portion 111*a* for laterally sliding locking edge portion 111*b* into locking edge portion 111*a* when laying the floor panels 101.

With continuing reference to FIG. 1B, the second locking edge portion 111*b* defining locking profile 117 of the second long edge 107*b* includes a horizontal locking feature 145, which is formed by locking channel 302, and a vertical locking feature 147 which is formed by a laterally outward extending tongue 148. Horizontal locking feature 145 is formed to be complementary in shape to the horizontal locking feature 131 of the locking profile 115 of the first long edge 107*a*, and a vertical locking feature 147 is formed to be complementary in shape to the vertical locking feature 135 of the locking profile 115 of the first long edge 107*a*. Locking edge portion 111*b* of a first floor panel 101 is therefore configured to be at least partially insertable into the locking edge portion 111*a* (or vice-versa) of an adjacent second floor panel, as further described herein.

Locking channel 134 is formed by a channel floor 302, an outer wall surface 151 extending upwards from the floor, and an inner wall surface 303 extending upwards from the floor and spaced horizontally apart from outer wall surface 151. It should be noted that locking channel 134 may extend longitudinally along the majority and substantially the entire length of locking edge portion 111*b*. The locking channel 134 defines an upward facing opening configured to receive locking tab 301 of locking edge profile 115.

Locking profile 117 also includes a peripheral outer sidewall 315, a laterally protruding cantilever arm 312 and a vertically protruding locking tab 149 extending upwards from channel floor 302. In one embodiment, tab 149 further includes a terminal cap portion 305 which defines an exposed surface facing in an upward direction. In one embodiment, tab 149 and cap portion 305 are vertically offset from the top surface 103 of floor panel 101. This creates a vertical gap between the top surface 103 and channel floor 302 for laterally sliding locking edge portion 111*a* into locking edge portion 111*b* when laying the floor panels 101. Locking profile 115 includes a laterally protruding cantilever arm 311 and a vertically protruding locking tab 301 extending in a downwards direction from channel roof 139.

Locking tab 149 defines inner wall surface 151. Inner wall surface 151 is positioned to engage outer sidewall 141 of locking channel 133 in locking profile 115 of locking edge portion 111*a*, thereby forming a horizontal interlock which prevents lateral withdrawal of locking tab 301 from channel 134. In this embodiment, therefore, inner wall surface 151 forms the horizontal locking feature 145. In one embodiment, outer wall surface 141 and outer wall surface 151 may each be obliquely angled with respect to the top and/or bottom surfaces 103, 105 of floor panel 101.

In one embodiment, the vertical locking feature 147 of locking profile 117 on long edge 107*b* comprises laterally outward extending tongue 307 which defines a downward facing horizontal locking surface 308. Tongue 307 extends laterally and partially into locking channel 134 forming a cantilevered portion creating a recess 309 below locking surface 308 within the channel for inserting tongue 137 on locking edge portion 111*a*. Locking surface 308 is arranged to engage an upward facing locking surface 310 formed locking tab 301 adjacent tongue 137, thereby forming a vertical interlock which prevents vertical withdrawal of locking tab 301 from channel 134.

Thus, a first floor panel 101 having the first locking profile 115 along one long edge portion 111*a* may be coupled in locking engagement with a second floor panel having the second locking profile 117 along an opposite long edge portion 111*b*. The two locking profiles 115, 117 along the long edges 107*a*, 107*b* are therefore configured to provide both horizontal and vertical locking engagement in a manner known in the art "fold-to-lock" engagement (i.e. the floor panel edges generally require lateral insertion followed by a generally linear downward folding motion to assemble the floor joint).

Figure 2:
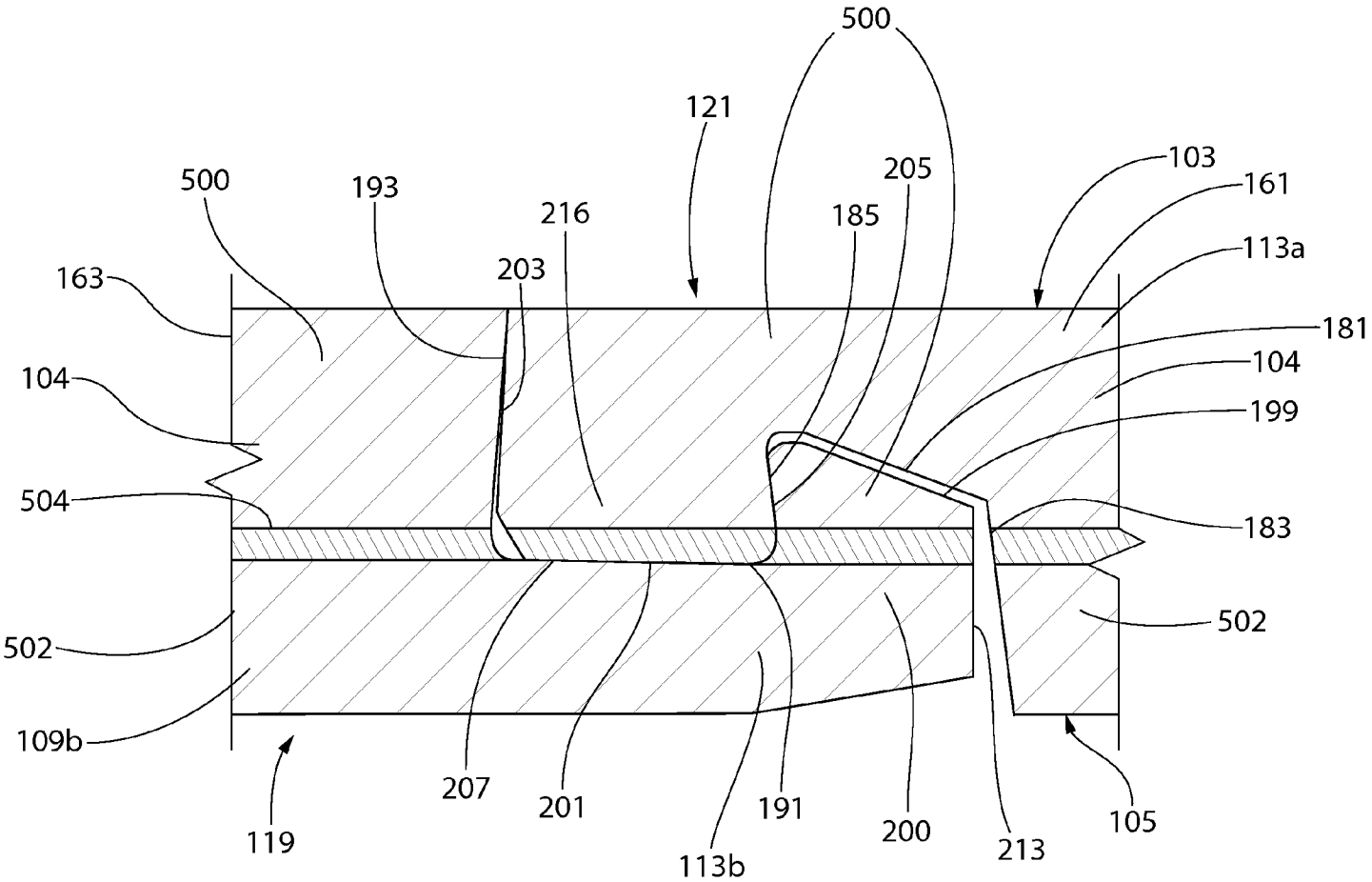
FIG. 2 is a side cross sectional view of the interlocked short edges shown in FIG. 1C of two adjacent floor panels.

FIG. 1C shows the locking edge profiles 119, 121 of the first short edge 109*a* and the second short edge 109*b*, respectively. FIG. 2 shows the same locking edge profiles 119, 121, each included as part of two separate and identically constructed floor panels 161, 163. Each of the two floor panels 161, 163 are constructed as shown in FIGS. 1A-C. In FIG. 2, the floor panels 161, 163 are shown assembled and interlocked in locking engagement along the respective short edges 109*a*, 109*b*.

Referring to FIGS. 1C and 2, the locking edge profile 119 of the first short edge 109*a* has a locking edge portion 113*b*, which includes both horizontal locking features 169 and vertical locking features 171. Similarly, the locking edge profile 121 of the second short edge 109*b* has a locking edge portion 113*a*, which includes both horizontal locking features 177 and vertical locking features 179. In certain embodiments, the horizontal locking features 169, 177 and the vertical locking features 171, 179 may share common structural elements in each respective locking edge profile 119, 121.

Referring particularly to FIG. 1C (right image), the horizontal locking feature 169 and vertical locking feature 171 of the locking edge portion 113*b* in one embodiment may both be formed by locking channel 201. Channel 201 may be formed by a first inner wall surface 203, a second outer wall surface 205, and a channel floor 207. Wall surfaces 203 and 205 are laterally spaced apart and extend upwards from the channel floor 207 toward the top surface 103. The locking channel 201 defines an upward facing opening configured to receive locking tab 216 of locking edge profile 121.

In one embodiment, channel 201 may be generally trapezoidal in shape having a wider bottom portion than top or entrance portion. Accordingly, wall surfaces 203 and 205 may be obliquely angled with respect to channel floor 207 and the vertical centerline axis 192 of the channel 201 such that each channel angles inwards towards the vertical centerline axis. Locking channel 201 thus includes an upper channel section, which is defined by upper portions of the first and second channel wall surfaces 203, 205 and a lower channel section, which is defined by lower portions of the first and second channel wall surfaces 203, 205. The upper channel section has a lateral width which is less than the width of second channel width.

It should be noted that locking channels 133, 134, 201, and 306 may extend laterally along the majority and substantially the entire width of locking edge portion 113*b*. This allows field cutting of the floor panels 101 in the field to fit the flooring layout requirements without adversely affecting the ability to interlock adjacent panels.

Locking profile 119 also includes a peripheral outer sidewall 213, laterally protruding cantilever arm 313 and a vertically protruding locking tab 200 extending upwards from channel floor 207. In one embodiment, tab 200 further includes a terminal cap portion 199 which defines an exposed top surface 209 of the tab facing in an upward direction. Top surface 209 may be obliquely angled with respect to top surface 103 of floor panel 101; however, in other embodiments surface 209 may be parallel to top surface 103 of the floor panel. In one embodiment, tab 200 and cap portion 199 are vertically offset from the top surface 103 of floor panel 101. This creates a vertical gap between the top surface 103 and cap portion 199 for receiving mating locking tab 216 of locking edge portion 113*a* when laying the floor panels 101.

Locking tab 200 defines outer surface 205. Outer wall surface 205 is positioned to engage outer wall surface 185 of locking channel 306 in locking profile 121 of locking edge portion 113*b* thereby forming a horizontal interlock which prevents lateral withdrawal of locking tab 216 from channel 201. In this embodiment, therefore, outer wall surface 205 forms the horizontal locking feature 169. In one embodiment, outer wall surface 205 and outer wall surface 185 may each be obliquely angled with respect to the top and/or bottom surfaces 103, 105 of floor panel 101.

Vertical locking feature 171 of locking edge portion 113*b* is also formed by outer wall surface 205 due to the foregoing oblique orientation of mutually engaging outer wall surface 205 and outer wall surface 185 on locking edge portion 113*a*. This resists vertical withdrawal of locking tab 216 from locking channel 201 when seated therein.

Referring particularly to FIG. 1C (left image), the horizontal locking feature 169 and vertical locking feature 171 of the opposite locking edge portion 113*a* in one embodiment may both be formed by locking channel 306. Channel 306 may be formed by a first inner wall surface 183, a second outer wall surface 185, and a channel roof 181. Wall surfaces 183 and 185 are laterally spaced apart and extend downwards from the channel roof 181 toward the top surface 103 of floor panel 101. The locking channel 306 defines a downward facing opening configured to receive locking tab 200 of locking edge profile 119.

In one embodiment, wall surfaces 203 and 205 of locking channel 306 may each be obliquely angled with respect to channel roof 181 and the vertical centerline axis 210 of the channel in opposite directions such that the top portion of wall surface 185 is farther from axis 210 than its bottom portion, and the top portion of wall surface 183 is closer to axis 210 than its bottom portion as shown. Other angular arrangements are possible and the invention is not so limited.

In one embodiment, channel roof 187 may be obliquely angled with respect to the top surface 103 of floor panel 101. The mating top surface 209 of locking tab 200 may have a complementary oblique angle which follows the slope of channel roof 187 (see FIG. 2) to provide a snug fit when the flooring joint is assembled. In other embodiments, channel roof 187 may be parallel to top surface 103 of the floor panel. Regardless of angular or parallel orientation, the top surface 209 and channel roof 187 may be arranged in substantially proximate and parallel relationship to each other when the floor joint is assembled.

Locking profile 121 also includes a peripheral outer sidewall 193, laterally protruding cantilever arm 314 and a vertically protruding locking tab 216 extending downwards from channel roof 187. In one embodiment, tab 216 further includes a terminal cap portion 191 which defines an exposed bottom tab surface 222 of the tab facing in a downward direction. In one embodiment, tab 216 and cap portion 191 are vertically offset from the bottom surface 105 of floor panel 101. This creates a vertical gap between the cap portion 191 and subfloor for receiving locking tab 200 of locking edge portion 113*a* when laying the floor panels 101.

Locking tab 216 defines outer surface 185. Wall surface 185 is positioned to engage outer wall surface 205 of locking channel 201 in locking profile 119 of locking edge portion 113*b*, thereby forming a horizontal interlock which prevents lateral withdrawal of locking tab 216 of locking edge portion 113*a* from channel 201 of locking edge portion 113*b*. In this embodiment, therefore, outer wall surface 185 forms the horizontal locking feature 177. In one embodiment, outer wall surface 185 and outer wall surface 205 may each be obliquely angled with respect to the top and/or bottom surfaces 103, 105 of floor panel 101.

Vertical locking feature 179 of locking edge portion 113*a* is also formed by outer wall surface 185 due to the foregoing oblique orientation of mutually engaging outer wall surface 185 and outer wall surface 205 on locking edge portion 113*b*. This resists vertical withdrawal of locking tab 200 from locking channel 306 when seated therein.

FIG. 2 shows the assembled floor panel joint of the short edges 109*a*, 109*b* of two longitudinally adjacent floor panels (i.e. end to end). Thus, as shown, a first floor panel 101 having the first locking profile 119 along one short locking edge portion 113*b* may be coupled in locking engagement with a second floor panel having the second locking profile 121 along an opposite short locking edge portion 113*a*. The two locking profiles 119, 121 along the short edges 109*a*, 109*b* are therefore complementary configured to provide both horizontal and vertical locking engagement in a manner known in the art "push-to-lock" engagement (i.e. the floor panel edges do not require lateral insertion, only a generally linear downward motion to assemble the floor joint). Locking tab 216 of locking edge portion 113*a* is inserted and positioned in locking channel 201 of locking edge portion 113*b*. Vertical centerline axis 192 of locking channel 201 is axially aligned with vertical centerline axis 212 of locking channel 306 when the joint is fully assembled.

Referring to FIGS. 1B, 1C, and 2, floor panel 101 may have a composite construction as shown. According to one embodiment, floor panel 101 may also functions to reduce and suppress noise in the joints between adjoining panels when traveled over by a person through incorporation of a resilient sound-absorbing layer embedded within the panel, as further described herein.

The composite floor panel 101 includes a layer of an upper core 500, a layer of a lower core 502, and a resilient sound-absorbing intermediate layer 504. Intermediate layer 504 is interspersed between the top and lower cores 500, 502 at the internal interface between the cores. The upper core 500 defines the top surface 103 and lower core 502 defines bottom surface 105. Intermediate layer 504 extends horizontal and may be oriented generally parallel to the top and/or bottom surfaces 103, 105.

Upper and lower cores 500, 502 may be made of any natural or synthetic materials and combinations thereof. In some non-limiting examples, the cores may be made of an engineered wood product such as HDF (high density fiberboard) or MDF (medium density fiberboard), hardwoods, or other materials.

Representative thicknesses T1 and T2 (vertically measured) for top and lower cores 500, 502 respectively may be without limitation about 6-7 mm in some non-limiting examples. Cores 500 and 502 may have the same or different thicknesses.

Intermediate layer 504 may be comprised of a flexible resilient sound-absorbing material which is compressible under pressure and recoverable after removal of pressure. In certain embodiments, the intermediate layer 504 may be formed of a flexible and compressible, yet non-resilient material meaning the material may be deformed but does not have an elastic memory and ability to spring back and return to its original thickness or configuration. The flexible sound-absorbing material possesses a higher degree of deformability and lower hardness than the more rigid materials which may be used for upper and lower cores 500, 502. The density of the intermediate layer 504 is therefore correspondingly less than the density of either the upper or lower cores 500, 502. Suitable materials that may be used for intermediate layer 504 include without limitation polymers, elastomers, adhesives (e.g. pressure sensitive adhesive layer), polymer foams, rubber, cork, cork rubber compositions, and other resilient type materials. In one embodiment, the pressure sensitive material may be for example without limitation a commercially-available adhesive tape, film, or sheet such as those provided by Flexcon of Spencer, Mass. Other resilient materials may be used for the intermediate layer 504.

In addition to the benefit of decreasing noise between the floor panel joints produced when an individual or equipment moves across the flooring (particularly as the floor installation ages over time), the resilient intermediate layer 504 provides installation advantages as well. By including the resilient intermediate layer 504 which is more compressible than the rigid core material into portions of the locking edge profiles 115, 117, 119, 121 (e.g. locking edge portions, locking tabs, cap portions, locking channels, and locking channels) of floor panel 101 as described herein, the short edges 109*a*, 109*b* of adjacent floor panels may advantageously enter into locking engagement more easily, i.e., with less force required during installation for the "push-to-lock" engagement to be established. Assembly of the long edges 111*a* and 111*b* of the floor panels 101 is similarly facilitated.

For example, for floor panels having short edges configured as shown in FIG. 2, the locking tabs of the plurality of floor panels 101 may be pressed into and nest within corresponding locking channels and channels of adjacent ones of the plurality of floor panels. As the locking tabs are being pressed into the locking channels and channels, the portions formed of the resilient intermediate layer 504 material are compressed, thereby more readily achieving a proper interference fit.

The intermediate layer 504 may have varying thicknesses, which may be used to adjust the noise reduction properties of the composite floor panel 101. Representative thicknesses T3 which may be used are about 0.5 to 2 Mils. The total thickness (T1+T2+T3) of the composite floor panel 101 may be in the range of about and including 12-14 mm (+/−) in some constructions. Other thicknesses of the cores and entire floor panel may of course be used depending on the specific application requirements.

In certain embodiments, the intermediate layer 504 is formed of a material that has a greater degree of flexibility and/or resiliency relative to the materials of each of the upper and lower cores 500, 502. Conversely, each of the upper and lower cores 500, 502 may be formed of a material that has a greater degree of rigidity than the material of the resilient intermediate layer 504. In on embodiment, the intermediate layer 504 has a hardness and density which is less than the upper and lower cores 500, 502. The upper and lower cores 500, 502 may be made of the same or different materials. Accordingly, the hardness of the cores 500 and 502 may be the same or different.

The intermediate layer 504 may be formed, in certain embodiments, of a resilient (i.e., elastomeric) material and may be flexible and/or compressible in addition thereto or instead thereof. Suitable elastomeric materials include rubber, an elastomer, elastomeric thermoplastics, foam, cork, foamed polymeric materials, and the like. In other embodiments, the second material may be an adhesive, such as an acrylic adhesive or a silicone laminating adhesive, such as FLEXmount A-374 or Densil LTS-1 adhesives.

In certain embodiments, the material of the intermediate layer 504 may be in a range of 5 to 70 Shore A hardness, with 15 to 55 Shore A hardness being possibly preferred. In certain embodiments, each of the upper and lower cores 500, 502 may be formed of a material having a hardness that is greater than 85 lbf wherein hardness in this instance is tested in accordance with ASTM C367-95.

The intermediate layer 504 may be permanently embedded in floor panel 101 in one embodiment, thereby forming an integral part of the flooring structure which cannot be removed without physically destroying the panel. Such a structure may be formed by any suitable method now known or later developed. In certain non-limiting embodiments, the composite floor panel 101 may be formed for example by laminating the top and lower cores 500, 502 together under suitable heat and pressure in a process with the intermediate layer 504 disposed therebetween. The intermediate layer 504 may be applied between the cores 500 and 502 may any suitable method, such as without limitation a roll coating process (i.e. to one internal surface of either core) or laminated as a sheet of material drawn from a roll while laminating the cores together in a single process step.

Advantageously, it further bears noting separating the base layer 104 into two separate top and lower cores 500, 502 of a composite floor panel structure as opposed to using a single monolithic base layer reduces the fundamental frequency of the structure, thereby helping to reduce noise.

In one embodiment of a process for fabricating floor panel 101, the floor panel locking edge portions and their locking profiles described herein may be formed after the composite floor panel structure is fabricated by any suitable method or combination of methods. Exemplary methods for forming the locking profiles may include without limitation cutting, milling, routing, drilling, and others. Method which may be used for forming composite floor panels 101 which incorporate intermediate layer 504 during the process include lamination, pressing, calendaring, combinations thereof, and others.

The sound-absorbing intermediate layer 504 may be disposed at any suitable vertical location between the top and bottom surfaces 103, 105 of the floor panel 101. FIGS. 1B-C and 2 show one possible, but non-limiting exemplary positioning of intermediate layer 504. Intermediate layer 504 lies in horizontal plane which may be substantially parallel to at least one of the top and bottom surfaces 103, 105 of floor panel 101, or both top and bottom surfaces. In other possible embodiments, intermediate layer 504 may be obliquely oriented with respect to the top and bottom surfaces 103, 105.

Intermediate layer 504 may be substantially continuous in structure between the peripheral outer sidewalls 193, 201, 315, and 316 of the short edges 109*a*, 109*b* and long edges 107*a*, 107*b* of the composite floor panel 101 except for some interruptions created within the various peripheral locking edge portions 111*a*, 111*b* and 113*a*, 113*b*. Accordingly, intermediate layer 504 may horizontally traverse substantially all or the entire interior central main body 102 of the panel longitudinally and laterally without interruption in some embodiments. In another alternate arrangement with reference to FIG. 1A, the intermediate layer 504 may not extend across the entire length and width of the main body 102 of floor panel 101, but rather may be in the configuration of a perimeter frame 99 within the main body 102 that extends into the various locking edge portions 111*a*, 111*b* and 113*a*, 113*b*. The perimeter frame 99 is represented by the dashed lines in FIG. 1A. It will be appreciated that other arrangements and extents of intermediate layer 504 however are possible.

According to one aspect, the sound-absorbing intermediate layer 504 from the main body 102 of floor panel 101 may extend into and be incorporated with at least a portion of one of the locking edge profiles 115, 117, 119, and 121 of floor panel 101 by appropriate vertical positioning of the intermediate layer between the top and bottom surfaces 103, 105 of the floor panel. This places the sound-absorbing material directly into the locking edge profiles, thereby enhancing the noise suppression and facilitating assembly of the locking edge portions 111*a*, 111*b*, 113*a*, 113*b* of adjoining floor panels. The intermediate layer 504 in the locking edge portions will be at the same elevation and in the same horizontal plane as the intermediate layer in the main body 102 of the floor panel because it is integrally formed with assembly of upper and lower cores 500, 501. The intermediate layer 504 may therefore be vertically positioned to further form at least a portion of the roof, floor, or wall surfaces of the locking channels and locking tabs described above.

For example, in one embodiment shown in FIGS. 1B-C and 2, the intermediate layer 504 may be positioned between the top and bottom surfaces 103, 105 of floor panel 101 to form: (1) a portion of the upper section of wall surface 143 of locking channel 133; (2) the floor 302 of locking channel 134 and a portion of locking tab 149 below cap portion 305 and cantilever arm 312 on locking edge portion 111*b*; (3) a portion of the lower sections of wall surfaces 203, 205 adjacent floor 207 of locking channel 201 and a portion of locking tab 200 below cap portion 199; and (4) a portion of wall surfaces 183, 185 of locking channel 306 and the cap portion 191.

In this embodiment, intermediate layer 504 extends laterally/horizontally from main body 104 completely through cantilever arm 312 to lateral sidewall 315. In this embodiment, both cap portion 305 on locking tab 149 and cap portion 199 on locking tab 200 are both formed of upper core 500 and isolated from lower core 502 by intermediate layer 504. Advantageously, the cap portions 305 and 199 are in essence spring-loaded and movably compressible vertically with respect to lower core 502 to not only improve sound absorption, but also to ease assembly of the respective mating locking edge portions. In addition, as a person walks across the floor joint, the cap portions may be slightly compressed under the downward vertical force applied and resiliently spring back up to reduce noise generation in the joint. FIG. 2 shows the assembled floor panel joint of the short edges 109*a*, 109*b* of two longitudinally adjacent floor panels (i.e. end to end).

Figure 3A:
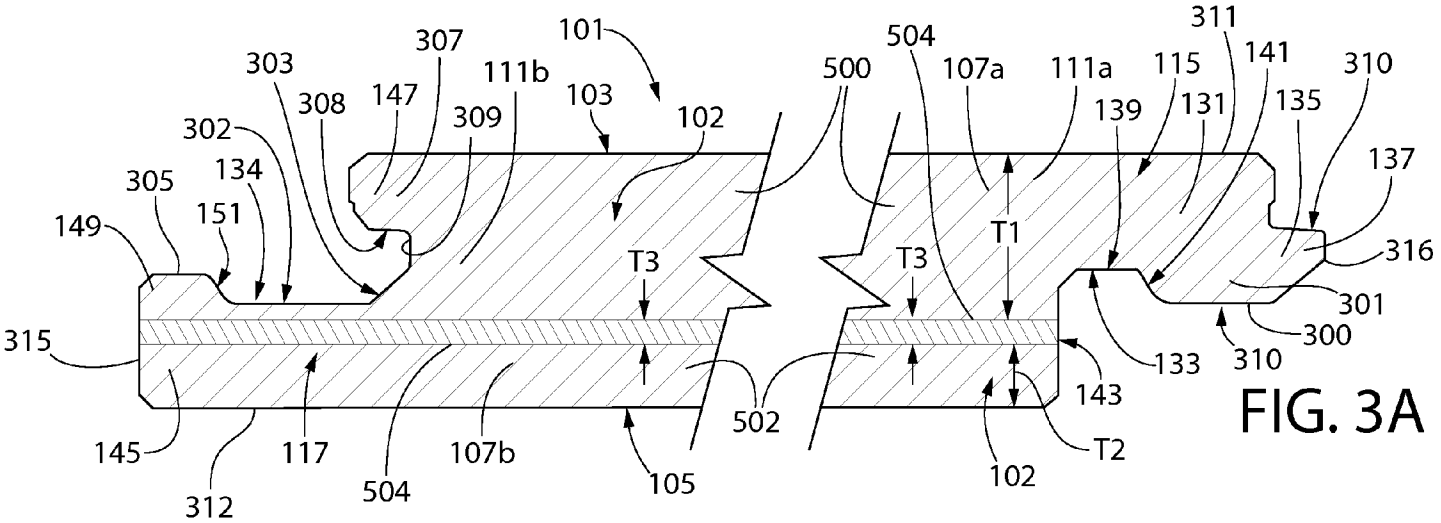
FIG. 3A is a side cross sectional view of a second embodiment of the floor panel taken along the line 1B-1B in FIG. 1A but showing alternate vertical positioning of the sound-absorbing layer.
Figure 3B:
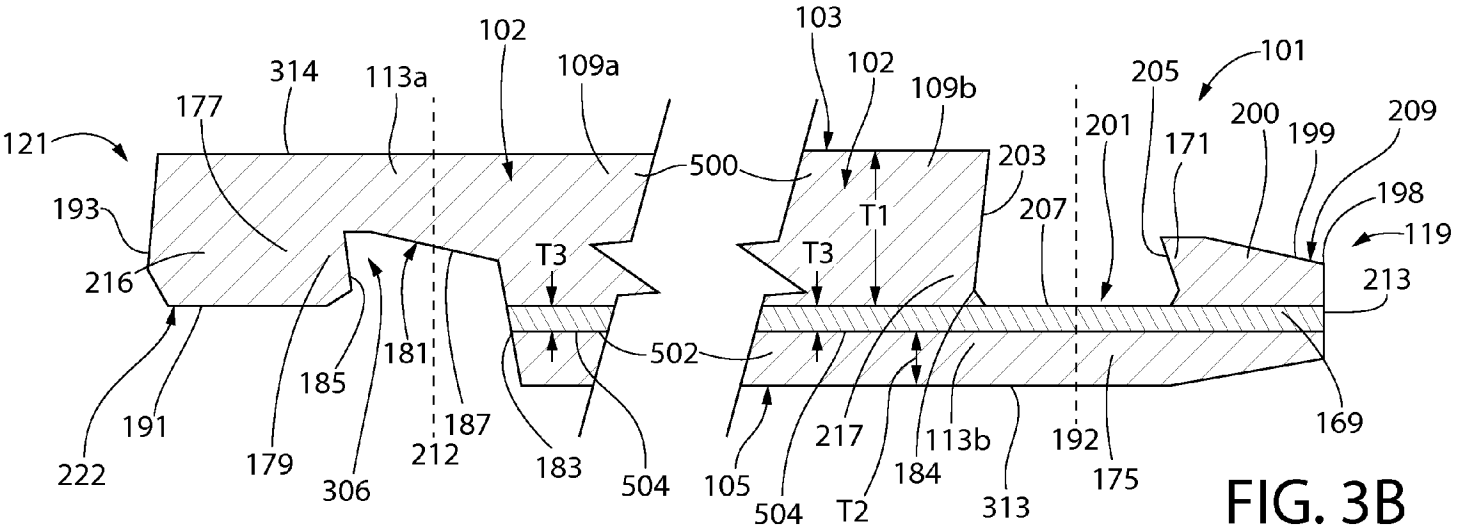
FIG. 3B is a side cross sectional view of a second embodiment of the floor panel taken along the line 1C-1C in FIG. 1A but showing alternate vertical positioning of the sound-absorbing layer.
Figure 4:
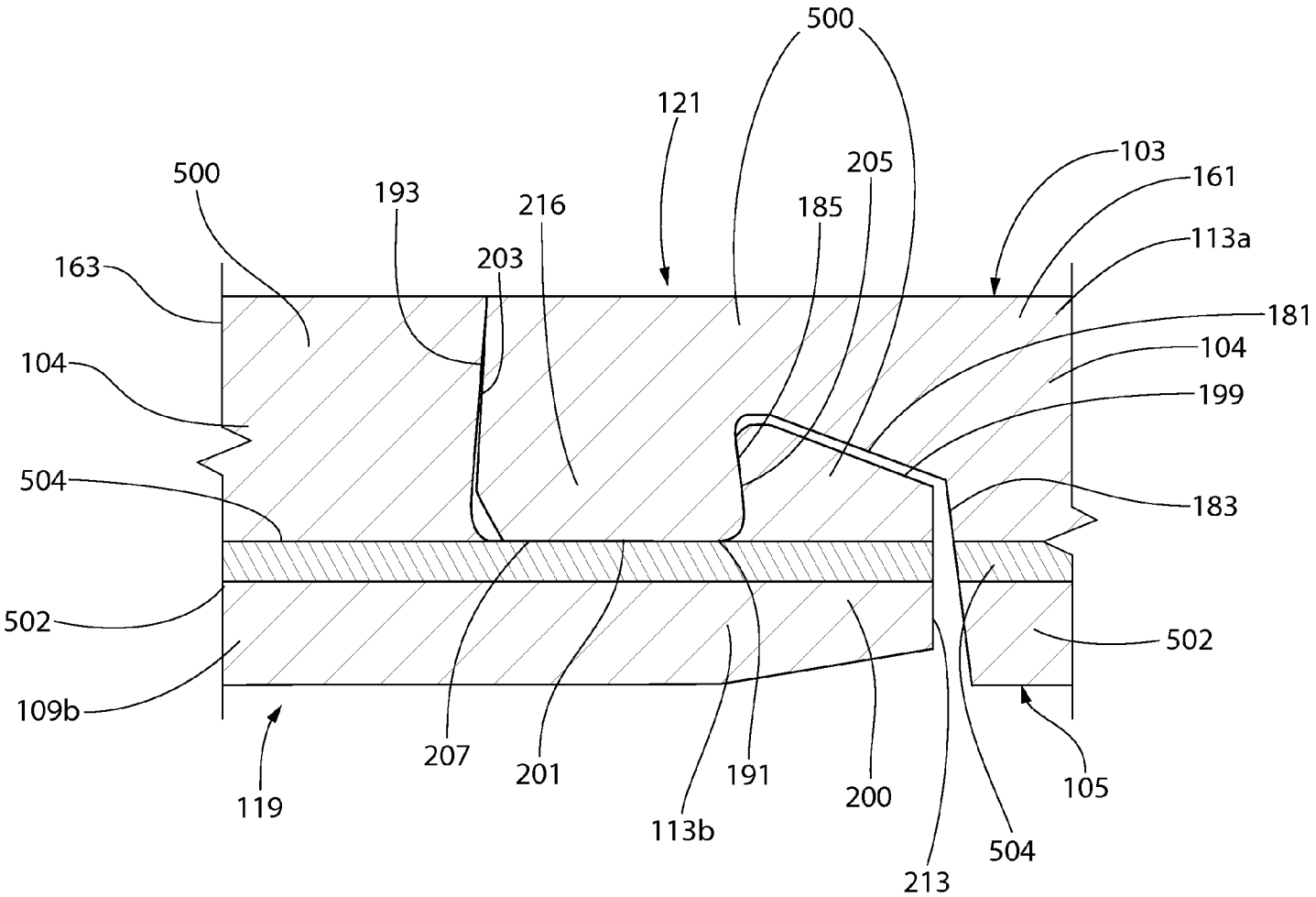
FIG. 4 is a side cross sectional view of the interlocked short edges shown in FIG. 3B of two adjacent floor panels.

FIGS. 3A-B and 4 depict another possible location of intermediate layer 504 in floor panel 101. In this embodiment, the intermediate layer 504 may be positioned between the top and bottom surfaces 103, 105 of floor panel 101 to form: (1) a portion of locking tab 149 and cantilever arm 312 on locking edge portion 111*b*; (2) the floor 207 of locking channel 201 and a portion of locking tab 200 below cap portion 199; and (3) a portion of inner wall surface 183 of locking channel 306. Intermediate layer 504 extends laterally/horizontally from main body 104 completely through cantilever arm 312 to lateral sidewall 315. In this embodiment, both cap portion 199 on locking tab 200 is formed of upper core 500 and isolated from lower core 502 by intermediate layer 504. FIG. 4 shows the assembled floor panel joint of the short edges 109*a*, 109*b* of two longitudinally adjacent floor panels (i.e. end to end).

Figure 5A:
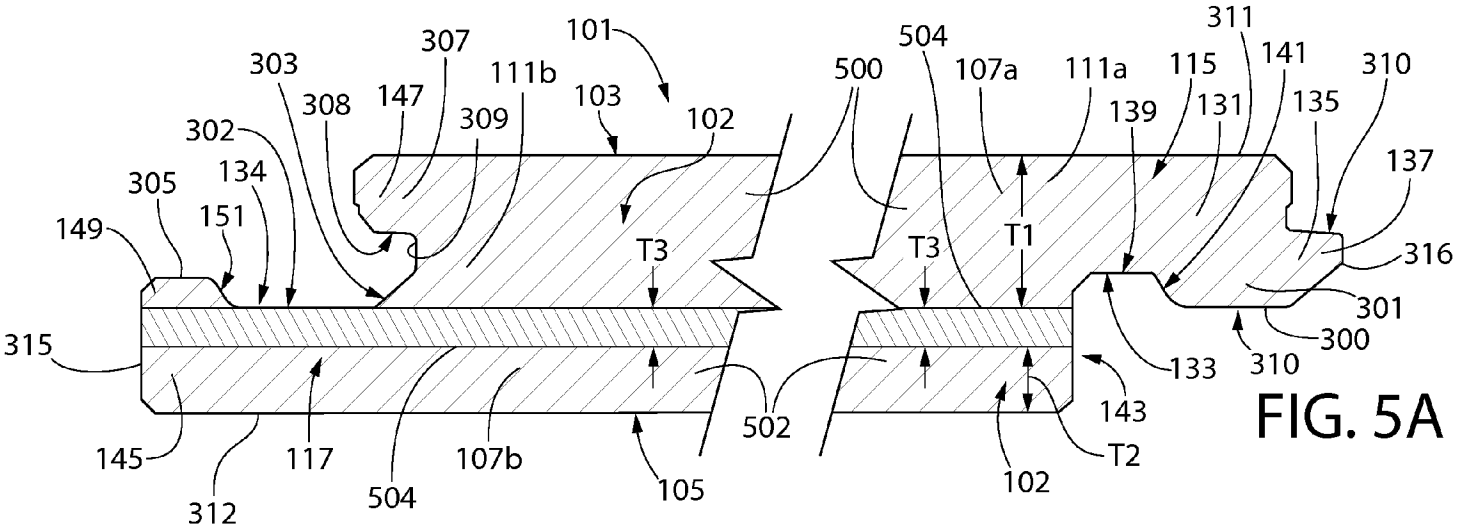
FIG. 5A is a side cross sectional view of a second embodiment of the floor panel taken along the line 1B-1B in FIG. 1A but showing alternate vertical positioning of the sound-absorbing layer.
Figure 5B:
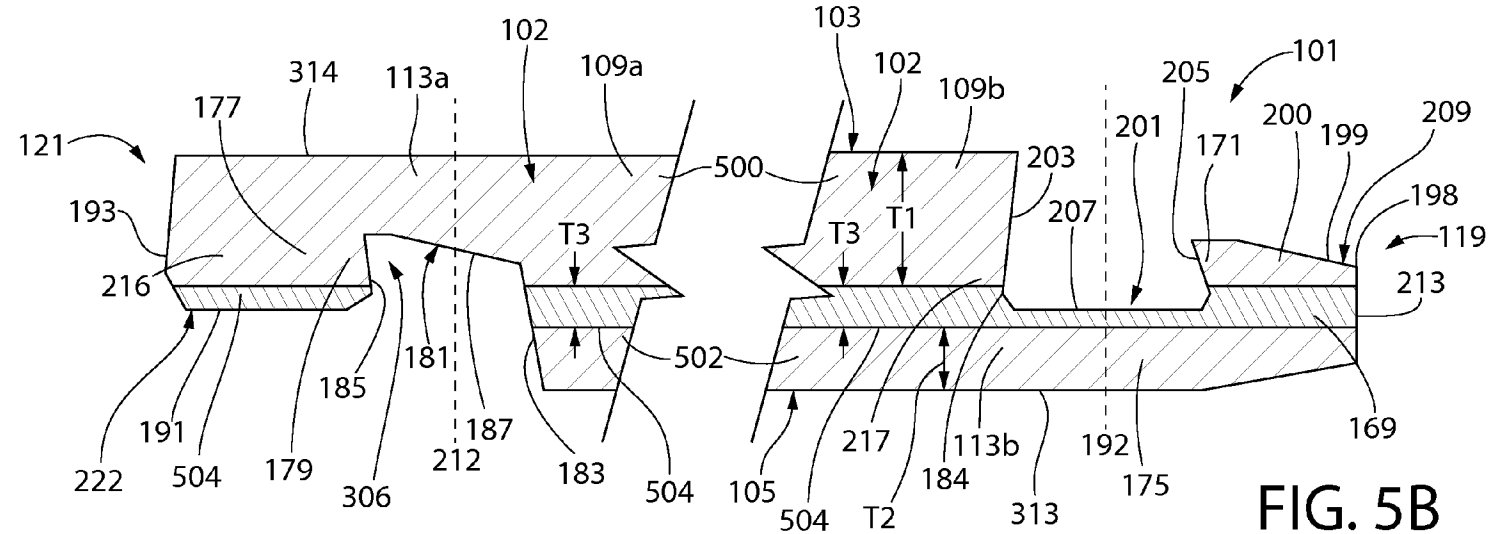
FIG. 5B is a side cross sectional view of a second embodiment of the floor panel taken along the line 1C-1C in FIG. 1A but showing alternate vertical positioning of the sound-absorbing layer.
Figure 6:
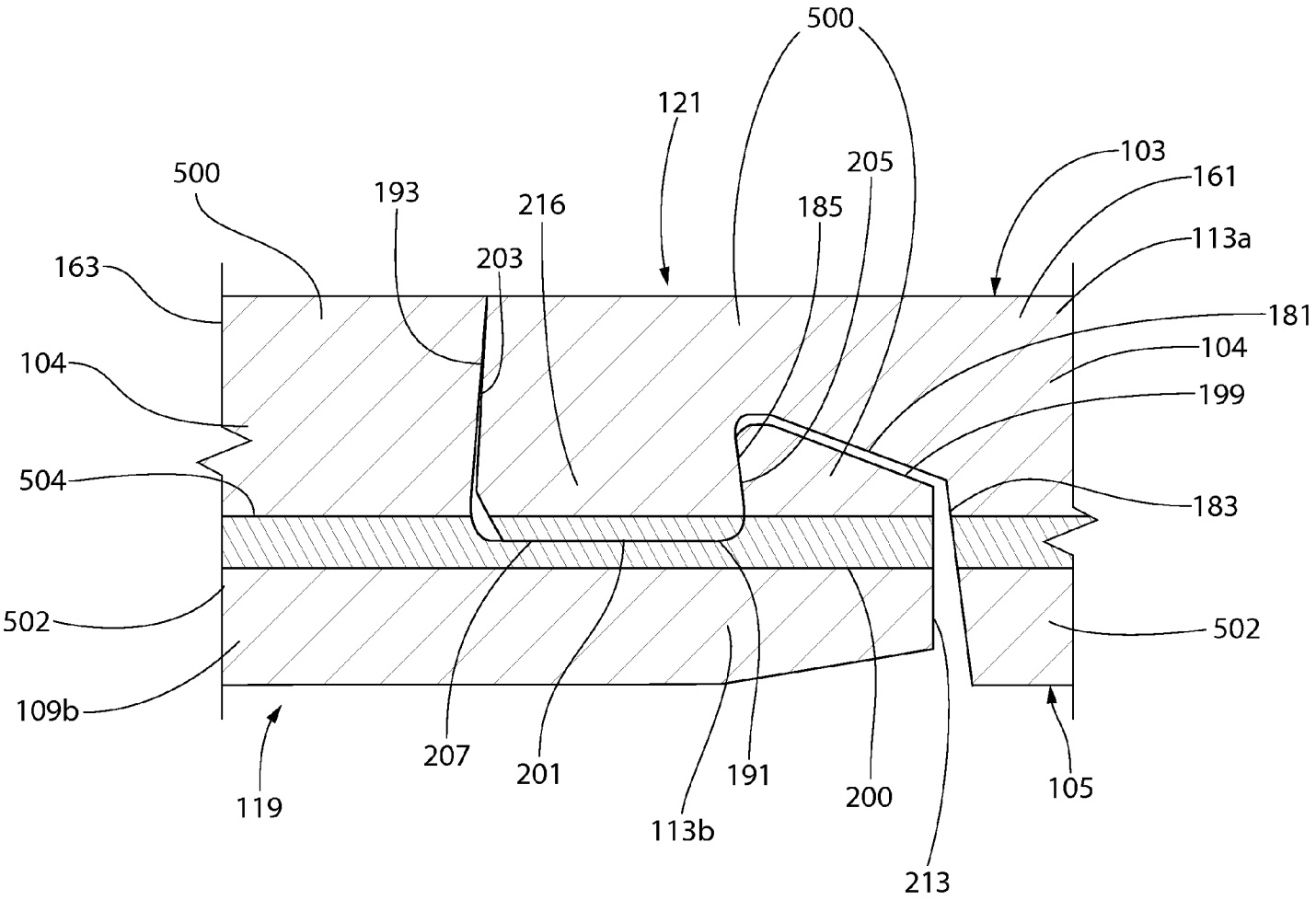
FIG. 6 is a side cross sectional view of the interlocked short edges shown in FIG. 5BC of two adjacent floor panels.

FIGS. 5A-B and 6 depict another possible location of intermediate layer 504 in floor panel 101. In this embodiment, the intermediate layer 504 may be positioned between the top and bottom surfaces 103, 105 of floor panel 101 to form: (1) a portion of locking tab 149 and cantilever arm 312 on locking edge portion 111*b*; (2) the floor 207 of locking channel 201 and a portion of locking tab 200 below cap portion 199; and (3) a portion of inner wall surface 183 of locking channel 306. Intermediate layer 504 extends laterally/horizontally from main body 104 completely through cantilever arm 312 to lateral sidewall 315. In this embodiment, both cap portion 199 on locking tab 200 is formed of upper core 500 and isolated from lower core 502 by intermediate layer 504. FIG. 6 shows the assembled floor panel joint of the short edges 109*a*, 109*b* of two longitudinally adjacent floor panels (i.e. end to end).

Figure 7:
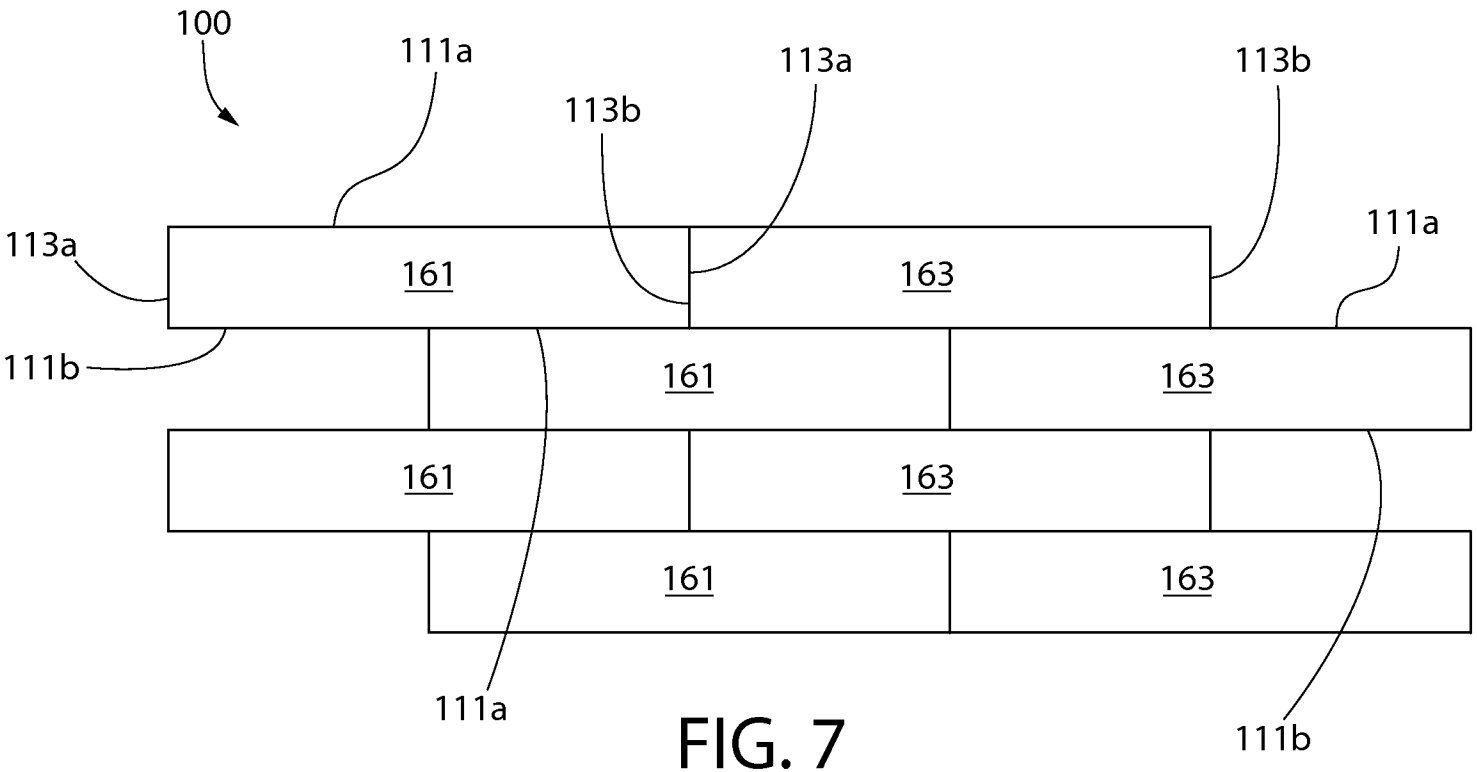
FIG. 7 is a top plan view of an assembled portion of the floating floor system using the floor panels disclosed herein.

FIG. 7 shows a partially assembled floating floor system comprising an array of floor panels 161 and 163 each having locking edge portions 111*a*, 111*b*, 113*a*, and 113*b* according any of the foregoing embodiments disclosed herein. Cross-sections of some exemplary joints between locking edge portions 113*a*, 113*b* of adjoining floor panels 161, 163 on the short edges of the panels are shown in FIGS. 2, 4, and 6. Although floor panels 161 and 163 have a rectangular plank form as shown in FIG. 7, it will be appreciated that the interlocked floor panels may also have other shapes including equal-sided square configurations that may be joined and arranged in a similar manner.

It will be appreciated that in other possible embodiments, more than two cores may be provided with a sound-absorbing intermediate layer 504 disposed between some or all of the cores that may be furnished. Accordingly, the invention is not limited to composite floor panel 101 constructions having only two cores 500, 502 alone which simply illustrate one non-limiting embodiment. In addition, floor panel 101 may include additional non-core layers for other purposes such as a bottom backing layer for engaging the subfloor or underlayment, a top wear layer, printed layer having a pattern or other design, and others.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A floating floor system comprising:

a plurality of floor panels, each of the plurality of floor panels comprising:

a main body comprising a first surface and a second surface;

a first locking edge portion extending from a first side of the main body, the first locking edge portion comprising a first locking tab and a first locking channel, the first locking channel defined by a first channel floor, a first inner sidewall, and a first outer sidewall, the first locking channel located between the first locking tab and the main body, the first locking tab comprising a first cap portion and forming the first outer sidewall of the first locking channel;

a second locking edge portion extending from a second side of the main body opposite the first side, the second locking edge portion comprising a second locking tab and a second locking channel, the second locking channel located between the second locking tab and the main body;

the first locking edge portion comprising an upper rigid core layer, a first flexible layer, and a lower rigid core layer, the first flexible layer disposed between the upper and lower rigid core layers, the first cap portion of the first locking tab formed by the upper rigid core layer; and the first flexible layer forming the first channel floor of the first locking channel;

the first flexible layer isolating the first cap portion of the first locking tab from the lower rigid core layer;

wherein the plurality of floor panels are arranged in a mechanically interlocked arrangement in which the second locking tabs of the plurality of floor panels nest within the first locking channels of adjacent ones of the plurality of floor panels and the first locking tabs of the plurality of floor panels nest within the second locking channels of the adjacent ones of the plurality of floor panels.

2. The floating floor system according to claim 1, wherein the first flexible layer is horizontally oriented between the first and second surfaces of the floor panel.

3. The floating floor system according to claim 1, wherein the main body further includes the first flexible layer, the first flexible layer extending horizontally from the main body into the first locking edge portion.

4. The floating floor system according to claim 1, wherein the first flexible layer is formed of a compressible material.

5. The floating floor system according to claim 1, wherein the first flexible layer is formed of a material having a lower hardness than the upper and lower rigid core layers.

6. The floating floor system according to claim 1, wherein the first flexible layer is selected from the group consisting of polymers, elastomers, adhesives, polymer foams, rubber, cork, and cork rubber compositions.

7. The floating floor system according to claim 1, wherein the upper and lower rigid core layers are each comprised of hardwood, high density fiberboard, or medium density fiberboard.

8. The floating floor system according to claim 1, further comprising:

wherein for each of the plurality of floor panels, the second locking tab of the second locking edge portion comprises a second cap portion, the second locking edge portion comprises the upper rigid core layer and the first flexible layer, and the second cap portion of the second locking tab is formed by the first flexible layer; and wherein in the mechanically interlocked arrangement, the second locking tabs of the plurality of floor panels nest within the first locking channels of the adjacent ones of the plurality of floor panels so that the second cap portions of the second locking tabs contact the first channel floors of the first locking channels.

9. The floating floor system according to claim 8, wherein for each of the plurality of floor panels, the first flexible layer forms at least a portion of each of the first inner sidewall and the first outer sidewall of the first locking channel.

10. A floating floor system comprising:

a plurality of floor panels, each of the plurality of floor panels comprising:

an upper core layer;

a lower core layer;

a resilient layer between the upper and lower core layers, the resilient layer formed of a material having a lower hardness than the upper and lower core layers;

a main body comprising the upper core layer, the lower core layer, and the resilient layer;

a first locking edge portion extending laterally from a first side of the main body, the first locking edge portion comprising a first locking tab and a first locking channel, the first locking channel located between the first locking tab and the main body, the first locking tab comprising a first cap portion;

a second locking edge portion extending from a second side of the main body opposite the first side, the second locking edge portion comprising a second locking tab and a second locking channel, the second locking channel located between the second locking tab and the main body, the second locking tab comprising a second cap portion;

the first cap portion being formed by the upper core layer, the resilient layer isolating the first cap portion of the first locking tab from the lower core layer; and the second locking edge portion comprises the upper core layer and the resilient layer, and the second cap portion of the second locking tab being formed by the first resilient layer; and wherein the plurality of floor panels are arranged in a mechanically interlocked arrangement in which the second locking tabs of the plurality of floor panels nest within the first locking channels of adjacent ones of the plurality of floor panels and the first locking tabs of the plurality of floor panels nest within the second locking channels of the adjacent ones of the plurality of floor panels.

11. The floating floor system according to claim 10, wherein in the mechanically interlocked arrangement, the second locking tabs of the plurality of floor panels nest within the first locking channels of the adjacent ones of the plurality of floor panels so that the second cap portions of the second locking tabs contact the first channel floors of the first locking channels.

12. The floating floor system according to claim 10, wherein the first locking channel defines an upward facing opening and the second locking channel defines a downward facing opening.

13. The floating floor system according to claim 10, wherein for each of the plurality of floor panels, the resilient layer forms a distal-most surface of the second locking tab.

14. The floating floor system according to claim 10, wherein the resilient layer is formed of a material having a lower hardness than the upper and lower core layers for each of the plurality of floor panels, the first locking channel is defined by a first channel floor, a first inner sidewall, and a first outer sidewall, and wherein at least a portion of the first outer sidewall is inclined toward the main body with distance from the first channel floor.

15. The floating floor system according to claim 10, wherein the upper and lower core layers are each comprised of hardwood, high density fiberboard, or medium density fiberboard.

16. A floating floor system comprising:

a plurality of floor panels, each of the plurality of floor panels comprising:

a main body comprising a first surface and a second surface;

a first locking edge portion extending from a first side of the main body, the first locking edge portion comprising a first locking tab and a first locking channel, the first locking channel located between the first locking tab and the main body, the first locking tab comprising a first cap portion and forming a first outer sidewall of the first locking channel;

a second locking edge portion extending from a second side of the main body opposite the first side, the second locking edge portion comprising a second locking tab and a second locking channel, the second locking channel located between the second locking tab and the main body;

the first locking edge portion comprising an upper layer formed of a first material having a first hardness, an intermediate layer formed of a second material having a second hardness, and a lower layer formed of a third material having a third hardness, the intermediate layer disposed between the upper and lower layers, the second hardness being less than each of the first hardness and the third hardness, the first cap portion of the first locking tab formed by the upper layer; and the intermediate layer isolating the first cap portion of the first locking tab from the lower layer; and wherein the plurality of floor panels are arranged in a mechanically interlocked arrangement in which the second locking tabs of the plurality of floor panels nest within the first locking channels of adjacent ones of the plurality of floor panels and the first locking tabs of the plurality of floor panels nest within the second locking channels of the adjacent ones of the plurality of floor panels.

17. The floating floor system according to claim 16, wherein for each of the plurality of floor panels, the first locking channel is defined by a first channel floor, a first inner sidewall, and the first outer sidewall, and the intermediate layer forms the first channel floor of the first locking channel.

18. The floating floor system according to claim 16, wherein for each of the plurality of floor panels, the first locking channel is defined by a first channel floor, a first inner sidewall, and the first outer sidewall, and wherein at least a portion of each of the first outer sidewall and the first inner sidewall is formed by the intermediate layer.

19. The floating floor system according to claim 16, wherein for each of the plurality of floor panels, at least a portion of the first outer sidewall is inclined toward the main body with distance from a first channel floor of the first locking channel.

20. The floating floor system according to claim 19, wherein for each of the plurality of floor panels, the portion of the first outer sidewall that is inclined toward the main body is formed at least in part by the first cap portion.

* * * * *